US005581627A

United States Patent [19]

Bowser et al.

[11] Patent Number: 5,581,627

[45] Date of Patent: Dec. 3, 1996

[54] CONVERTIBLE COVER HEADPHONES

[76] Inventors: Bradford E. Bowser, 77 Lake Dr. West, Westminster, Mass. 01473; Gerard H. LeClair, Chestnut St., East Longmeadow, Mass. 01028

[21] Appl. No.: 285,095

[22] Filed: Aug. 3, 1994

[51] Int. Cl.[6] ..... H04R 25/00

[52] U.S. Cl. ..... 38/183; 381/187; 381/188; 381/189

[58] Field of Search ..... 381/182, 183, 381/187, 180, 25, 188, 205; 379/430; 181/128, 129

[56] References Cited

U.S. PATENT DOCUMENTS

| | | | |
|---|---|---|---|
| 3,902,120 | 8/1975 | Dascal et al. | 381/183 |
| 4,542,803 | 9/1985 | Houng | 381/183 |
| 4,689,822 | 8/1987 | Huong | 381/183 |
| 4,941,187 | 7/1990 | Slater | 381/86 |
| 5,033,094 | 7/1991 | Hung | 381/183 |
| 5,117,464 | 5/1992 | Jones et al. | 381/183 |

OTHER PUBLICATIONS

An advertisement of the Stetomike HMT 808 by Danvox, Inc.

*Primary Examiner*—Forester W. Isen
*Assistant Examiner*—Duc Nguyen
*Attorney, Agent, or Firm*—George E. Kersey, Esq.

[57] ABSTRACT

A band having opposed ends and adapted for spanning the head of a user between opposed ears, with each end of the band including an ear phone mounted in a base attached to said band and an interchangeable and replaceable decorative cover for each base mounting an ear phone to permit interchange with another cover of different design. In a method of customizing a set of headphones, the steps include (A) applying a removable decorative outer cover to at least one ear phone of the set; and (B) removing the outer cover and replacing it by a different decorative outer cover.

20 Claims, 5 Drawing Sheets

FIG.2A
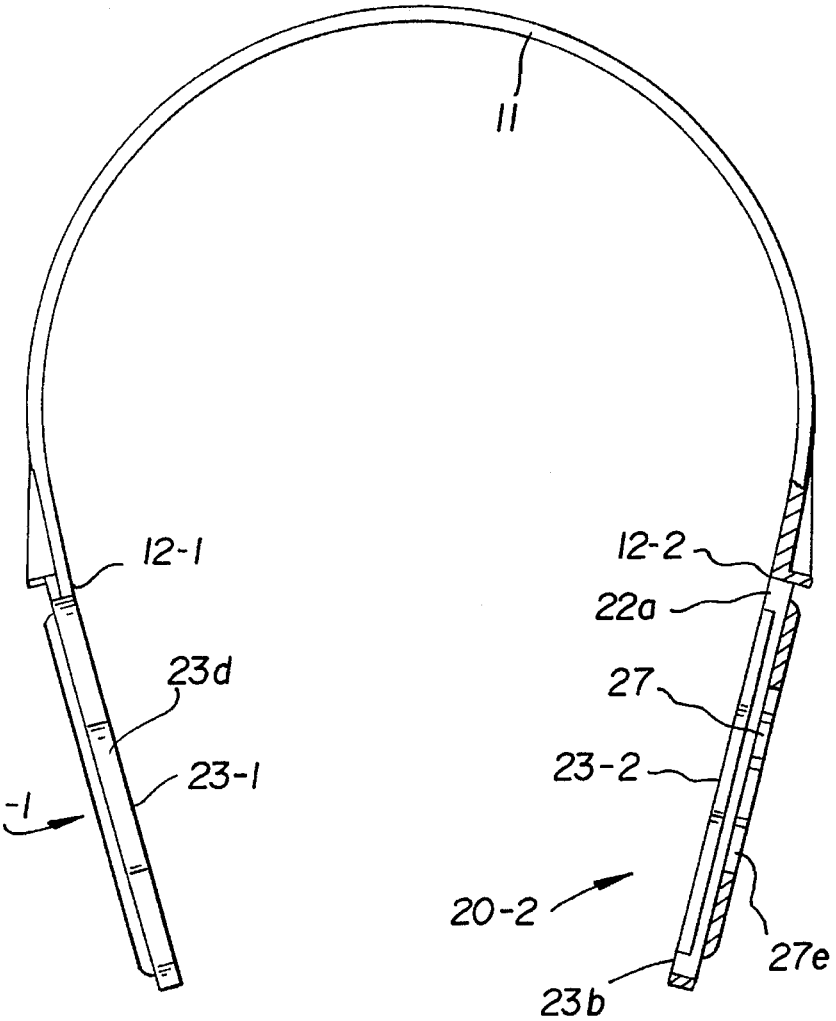
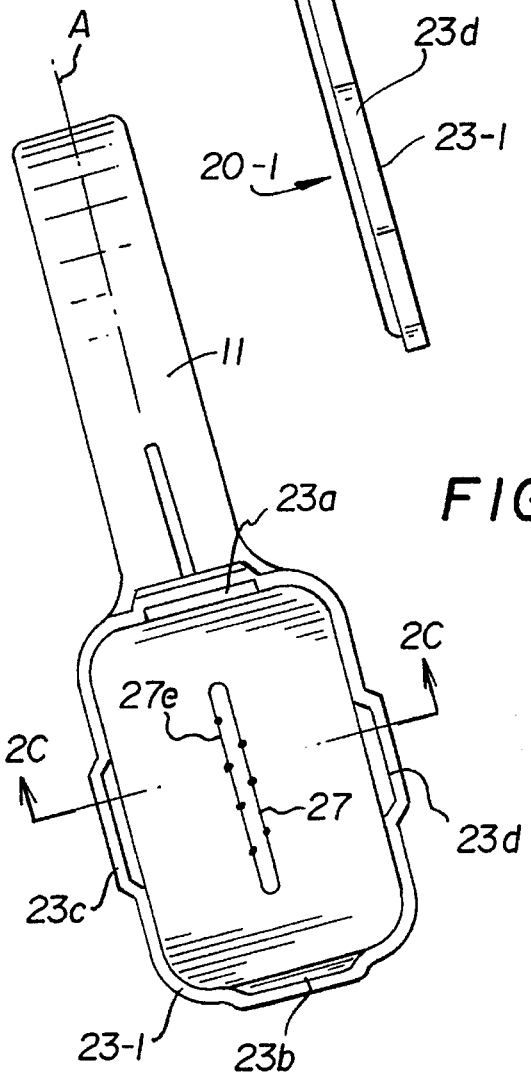
FIG. 2B
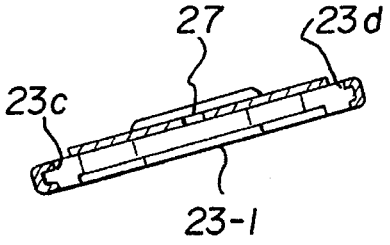
FIG. 2C

FIG. 3A
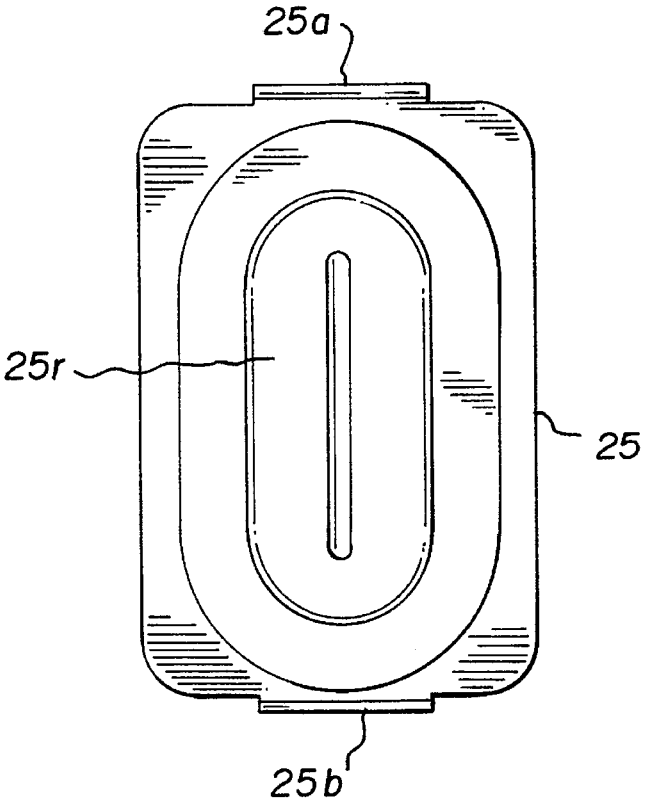
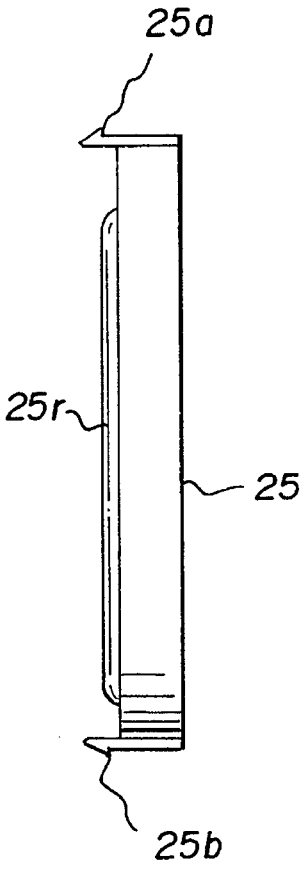
FIG. 3B
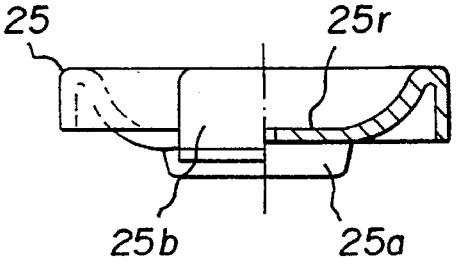
FIG. 3C

CONVERTIBLE COVER HEADPHONES

This invention relates to portable devices for the conversion of electrical energy into acoustic waves, and more particularly, to headphones for the conversion of electrical wave forms into sound

BACKGROUND OF THE INVENTION

Conventional headphones for the conversion of electrical signals into sound are typically provided with an adjustable band which can be increased or decreased in span in order to adapt the headphones to the head of a user. Unfortunately, in this arrangement, there tends to be slippage in the adjustable band, so that if the headphones are initially set for a proper span, they tend to lose the span and perform unsatisfactorily.

In addition, conventional headphones do not allow the individual user to customize his head set in accordance with his aesthetic sensibilities, or his desired adaptations of the head set.

Accordingly, it is an object of the invention to enhance the adaptation of headphones to the heads of users. A related object is to avoid the alterations in span that occur when adjustments are made by displacing segments of the span relative to one another.

A further object of the invention is to permit the user of headphones to customize them in accordance with a desire to provide a unique and alterable aesthetic effect.

SUMMARY OF THE INVENTION

In accomplishing the foregoing and related objects, the invention provides a pre-biased, nonextensible band having opposed ends, with symmetric ear pieces attached to the respective ends. Each ear piece includes a base and a cover, with the base having an adjustment channel and an ear phone mounted in the adjustment channel.

In accordance with one aspect of the invention, the pre-biased band is molded from a plastic material characterized by spacial memory which restores the band to its initial configuration following any displacement of the ends thereof. A suitable plastic material is a copolymer of styrene-acrilonitrile and butadiene-acrilonitrile (ABS).

Following placement of the band with its ear pieces positioned to transfer sound into the ears of a user, the band maintains its initial ear-contacting positions during usage because of the material from which the band is constructed, and the pre-biasing that takes place during processing, for example, by injection molding.

In accordance with another aspect of the invention, the span axis of the band extends in alignment with the axis of an adjustment channel within the individual ear pieces of their associated ear phones. The adjustment channel includes a plurality of engagement recesses for its associated ear phone. This allows the ear phone to be moved along the adjustment channel to an appropriate position in relation to the ear of a user.

The band desirably is pre-biased to form an angle of about 15 degrees between the end of the band and the attachment thereto of the associated ear phone.

In accordance with still another aspect of the invention, the band is adapted for spanning the head of a user between opposed ears, each end of the band includes an ear phone and an interchangeable and replaceable cover is provided for each earphone.

The replaceable cover for each ear phone is removably connectable to a holder to permit its interchange with another cover of different design. The replaceable cover can be configured with a prescribed design and be replaceable by a different cover having a different prescribed design. This allows a user to customize his headphones to provide a desired aesthetic effect.

In a method of customizing a set of headphones, the steps include (A) applying a removable outer cover to at least one ear phone of the set; and (B) removing the outer cover and replacing it by a different outer cover.

The removable outer cover can be configured with a prescribed design and the replacement outer cover can be configured with a different design.

DESCRIPTION OF THE DRAWINGS

Other aspects of the invention will become apparent after considering several illustrative embodiments taken in conjunction with the drawings in which:

FIG. 2A is a plan view of the head band and ear phones holder for the headphones of FIG. 1B;

FIG. 2B is a side view of FIG. 2A;

FIG. 2C is a sectional view of FIG. 2B taken along the lines B—B;

FIG. 3A is a plan view of a retainer insert for the holder of FIG. 2A;

FIG. 3B is a side view of FIG. 3A;

FIG. 3C is a sectional view of FIG. 3A taken along the lines C—C;

DETAILED DESCRIPTION

Figure 1A:
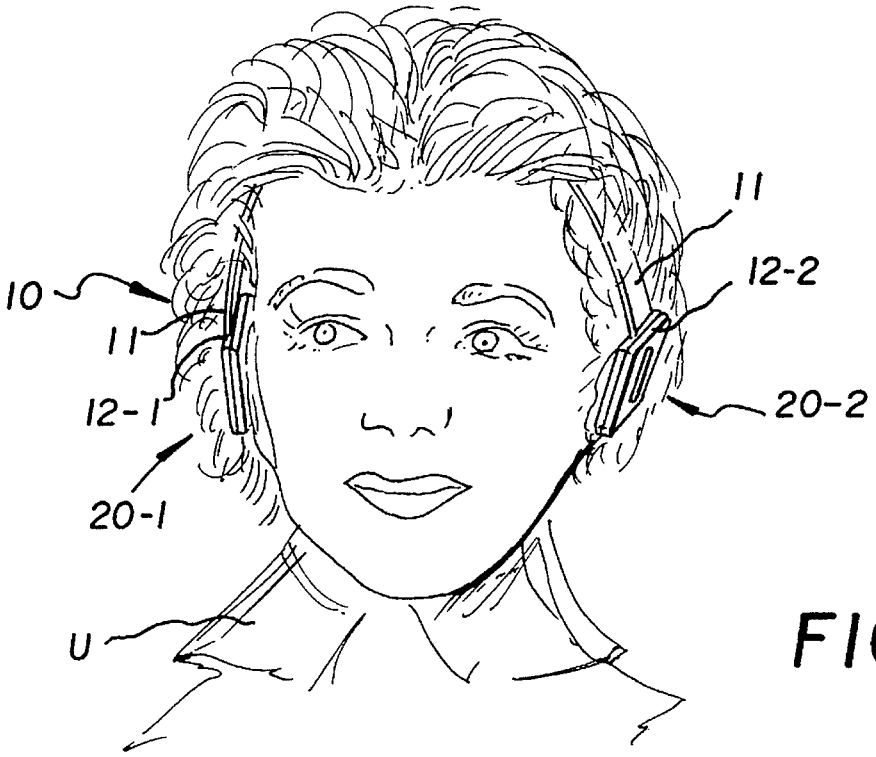
FIG. 1A is a diagram of a user with a set of headphones in accordance with the invention.

With reference to the drawings, FIG. 1A illustrates a user U with headphones 10 in accordance with the invention. The headphones 10 include a biased band 11 of suitable plastic material which span the head of the user U to position the ends 12-1 and 12-2 of the band 11 in the vicinity of the ears of the user where ear pieces 20-1 and 20-2 are used for respective ear phones (not visible in FIG. 1A). The ear pieces 20-1 and 20-2 have removable and interchangeable covers 21.

The pre-biased band 11 is molded from a plastic material characterized by spacial memory which restores the band to its initial configuration following any displacement of its ends. As a result the band maintains its initial ear contacting position during usage, following head placement with the ear pieces 20-1 and 20-2 positioned to transfer sound into the ears of the user U.

The band 11 is molded from a suitable material, such as a co-polymer of styrene-acrilonitrile and butadieneacrilonitrile (ABS) plastic. The band 11 is pre-biased to form an angle of about 15 degrees between each end 12-1 and 12-2 of the band 11 and the corresponding bases 23-1 and 232 that support the ear phones 21-1 and 21-2.

Figure 1B:
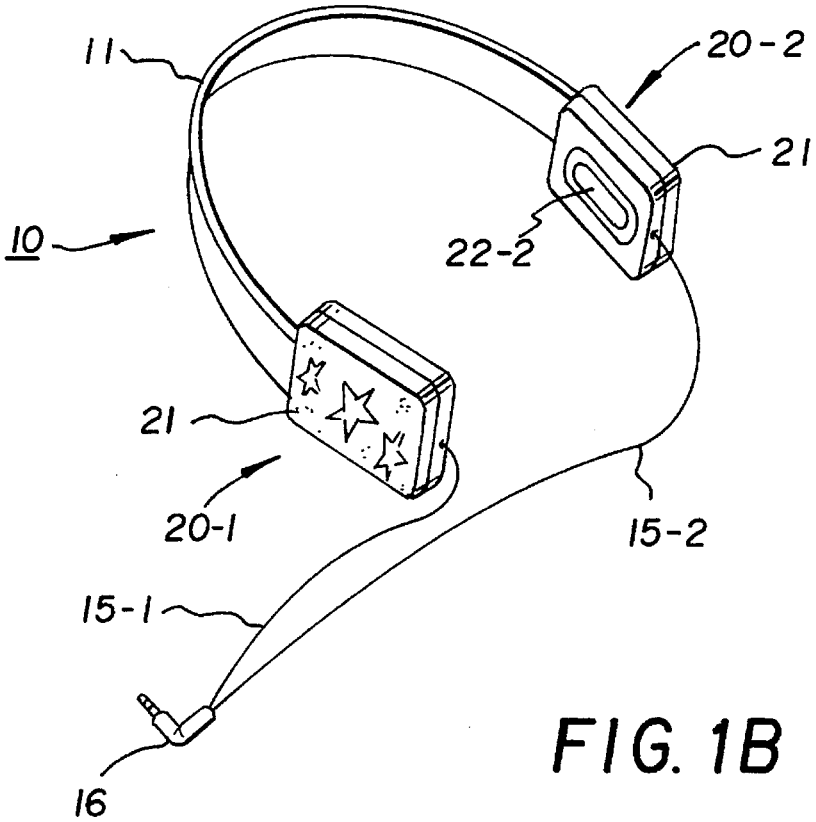
FIG. 1B is a perspective view of the headphones of FIG. 1A, after removal from the head of the user.

As seen in FIG. 1B, separate lines 15-1 and 15-2 extend from respective ear phones, of which only ear phone 22-2 is visible in FIG. 1B, to a jack 16 which is insertable into an electrical signal source, such as a radio or tape player (not shown).

As detailed in FIG. 2A, the pre-biased, nonextensible band 11 has opposed ends 12-1 and 12-2 which are attached to respective bases 23-1 and 23-2 of the symmetric ear pieces 20-1 and 20-2, shown in outline. Each base 23-1 and 23-2 has an adjustment channel 27, shown in FIG. 2B and in the base 23-2 of FIG. 2A, for an ear phone 22-1 or 22-2, which is mounted in the adjustment channel 27.

The band 11 has a span axis A and the adjustment channel 27 extends in the bases 23-1 and 23-2 in alignment with the span axis A of the band 11.

The adjustment channel 27 includes a plurality of engagement recesses 27*e* for each ear phone 21-1 and 21-2. This allows each of the ear phones 21-1 and 21-2 to be moved along the adjustment channel 27 to position the ear phones 21-1 and 21-2 appropriately in relation to the ears of the user U.

Figure 4:
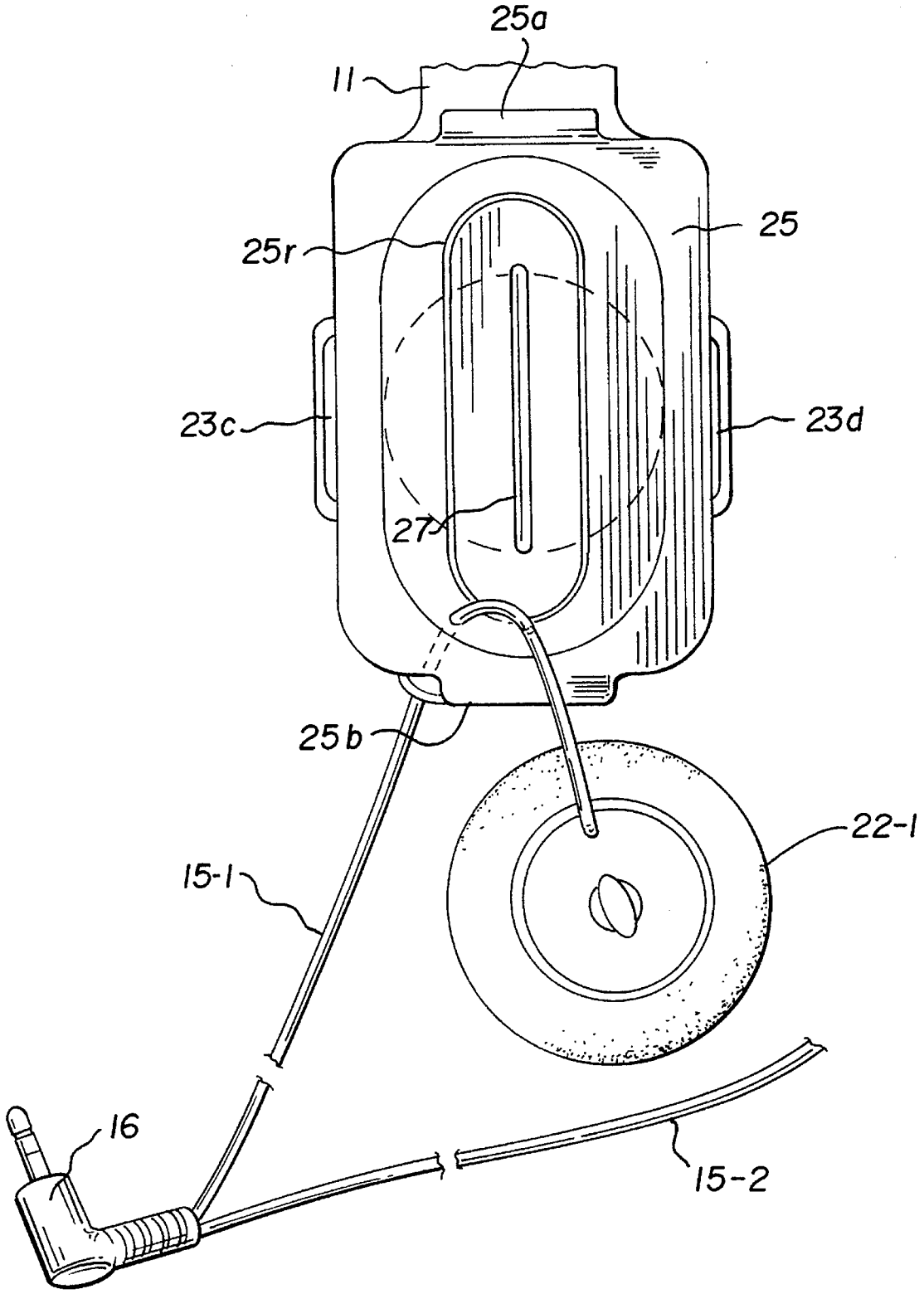
FIG. 4 is a partial view showing the relationship between the retainer insert of FIG. 3A and an associated ear phone.

As indicated in FIG. 3A, which is a plan view of a retainer insert 25 for the holder 23-1 or 23-2 of FIG. 2A, the insert 25 has prongs 25*a* and 25*b* which engage prongs 23*a* and 23*b* in FIGS. 2A through 2C. In addition the insert 25 has an oval recess 25*r* which accommodates an ear phone, such as the ear phone 22-1 or 22-2. FIG. 3B is a side view of FIG. 3A, and FIG. 3C is a sectional view of FIG. 3A taken along the lines C—C;

FIG. 4 is a partial view showing the relationship between the retainer insert 25 of FIG. 3A and an associated ear phone, such as the ear phone 22-1.

Figure 5A:
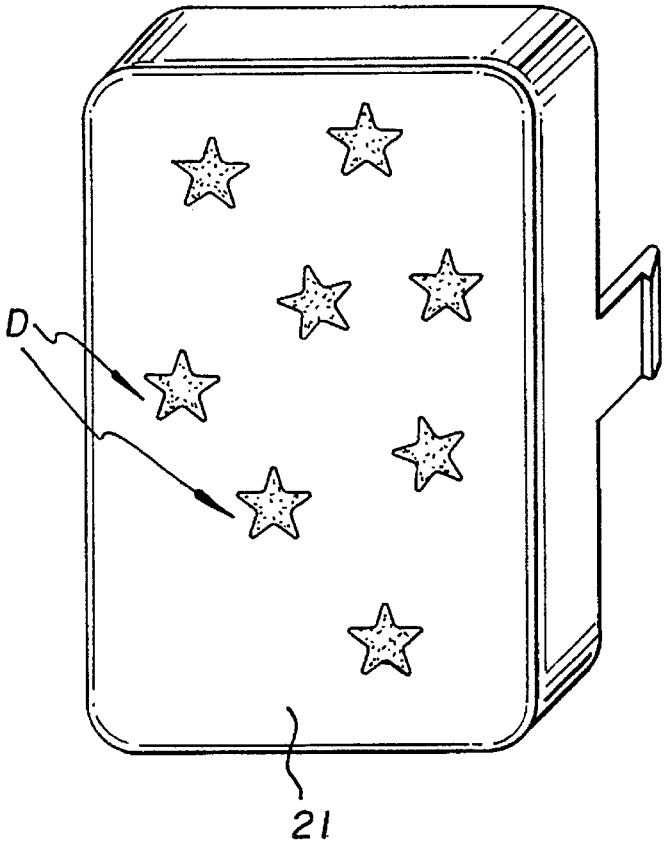
FIG. 5A is a plan view of a decoratable cover for the retainer insert of FIG. 3A.
Figure 5B:
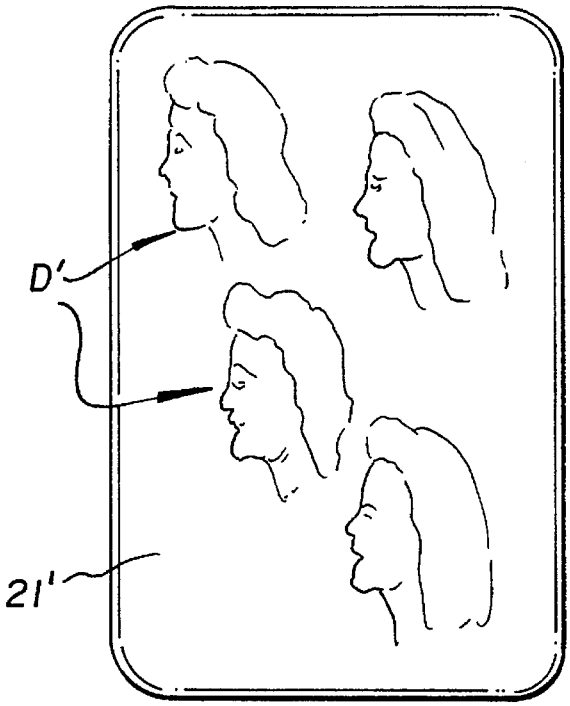
FIG. 5B illustrates an alternative decorative cover for the retainer insert of FIG. 3A.

In order to provide a user-controlled decorative option, the band 11, which has opposed ends 12-1 and 12-2 adapted for spanning the head of a user U between opposed ears. Each end of the band 11 includes an ear phone and an interchangeable and replaceable cover 21 for each earphone, shown with an illustrative decoration D in FIG. 5A. Each replaceable cover 21 is removably connectable to the holder 23-1 or 23-2 to permit the interchange with another cover of different design, such as the over 21' of FIG. 5B.

The replaceable cover 21 is configured with a prescribed design D and is replaceable by a different cover 21' having a different prescribed design D. This allows the user to customize the headphones 10 to provide a desired aesthetic effect.

In a method of customizing a set of headphones 10, the steps include (A) applying a removable outer cover 21 to at least one ear piece 20-1 or 20-2 of the set 11 and (B) removing the outer cover 21 and replacing it by a different outer cover 21'. The removable outer cover 21 is configured with a prescribed design D, and the replacement outer cover 21' is configured with a different design D'.

It will be understood that the foregoing detailed description is illustrative only, and that various modifications and adaptation may be made without departing from the spirit and scope of the invention, as defined in the appended claims.

What is claimed:

1. Apparatus comprising a pre-biased, nonextensible band having opposed ends;

and symmetric ear pieces attached to the respective ends;

each ear piece including a base and an outer cover with said base having an adjustment channel and an ear phone mounted in said adjustment channel; wherein said band has a span axis and said adjustment channel for mounting said ear phone extends in alignment with said span axis in said base.

2. Apparatus as defined in claim 1 wherein each outer cover is interchangeable and replaceable.

3. Apparatus as defined in claim 2 wherein each ear phone is positioned within said base and said replaceable cover is removably connectable to said base to permit the interchange thereof with another cover of different design.

4. Apparatus as defined in claim 1 wherein said pre-biased band is molded from a plastic material characterized by spacial memory with a molecular orientation which restores said band to its initial configuration following any displacement of the ends thereof.

5. Apparatus as defined in claim 1 wherein said band is rigidly attached to the bases of said ear pieces and, following head placement with said ear pieces positioned to transfer sound into the ears of a user, maintains its initial ear contacting position during usage.

6. Apparatus as defined in claim 1 wherein said adjustment channel in said base includes a plurality of engagement recesses for said ear phone;

whereby said ear phone can be moved along said adjustment channel in said base to position said ear phone appropriately in relation to the ear of a user.

7. Apparatus as defined in claim 1 wherein said band is molded from styrene-acrilonitrile butadiene-acrilonitrile copolymer plastic.

8. Apparatus as defined in claim 7 wherein said band is pre-biased to form a fixed angle of about 15 degrees between the end of said band and the attachment thereto of said base.

9. Apparatus comprising a pre-biased, nonextensible band having opposed ends;

and symmetric ear pieces attached to the respective ends;

each ear piece including a base and an outer cover with said base having an adjustment channel and an ear phone mounted in said adjustment channel;

wherein said pre-biased band is molded from a plastic material characterized by spacial memory with a molecular orientation which restores said band to its initial configuration following any displacement of the ends thereof, and said band is rigidly attached to the bases of said ear pieces so that following head placement with said ear pieces positioned to transfer sound into the ears of a user the initial ear contacting position is maintained during usage.

10. Apparatus as defined in claim 9 wherein each outer cover is interchangeable and replaceable.

11. Apparatus as defined in claim 10 wherein each ear phone is positioned within said base and said replaceable cover is removably connectable to said base to permit the interchange thereof with another cover of different design.

12. Apparatus as defined in claim 9 wherein said pre-biased band forms an angle of about 15 degrees between each end of said band and the corresponding bases that mount the ear phones, and separate lines extend from respective ones of said ear phones to a jack which is insertable into an electrical signal source.

13. Apparatus as defined in claim 12 wherein said band has a span axis and said adjustment channel extends in said bases in alignment with the span axis of said band.

14. Apparatus as defined in claim 13 wherein said adjustment channel includes a plurality of engagement recesses for each of said ear phones; thereby to allow each of said ear phones to be moved along said adjustment channel to position said ear phones appropriately in relation to the ears of a user.

15. Apparatus as defined in claim 14 wherein each of said bases has a retainer insert with prongs which engage prongs in said bases.

16. Apparatus comprising a band having opposed ends and adapted for spanning the head of a user between opposed ears;

each end of said band including an ear phone mounted in a base attached to said band; and an interchangeable and replaceable cover for each base mounting an ear phone;

wherein said band is pre-biased to form an angle of about 15 degrees between each end of said band and the corresponding bases that mount the ear phones and separate lines extend from respective ones of said ear phones to a jack which is insertable into an electrical signal source; said band is pre-biased and nonextensible with opposed ends which are fixedly attached to respective bases, each with an adjustment channel for an ear phone which is mounted in said adjustment channel.

17. Apparatus as defined in claim 16 wherein said band has a span axis and said adjustment channel extends in said bases in alignment with the span axis of said band.

18. Apparatus as defined in claim 17 wherein said adjustment channel includes a plurality of engagement recesses for each of said ear phones; thereby to allow each of said ear phones to be moved along said adjustment channel to position said ear phones appropriately in relation to the ears of a user.

19. Apparatus as defined in claim 18 wherein each of said bases has a retainer insert with prongs which engage prongs in said bases.

20. Apparatus as defined in claim 19 wherein said insert has an oval recess which accommodates an ear phone in a direct relationship between said retainer insert and an associated ear phone.

* * * * *